United States Patent [19]

Chase

[11] 4,412,194

[45] Oct. 25, 1983

[54] CONVERGENCE UNIT FOR IN-LINE COLOR CATHODE RAY TUBE

[75] Inventor: Brian D. Chase, Eastleigh, England

[73] Assignee: International Business Machines Corporation, Armonk, N.Y.

[21] Appl. No.: 454,399

[22] Filed: Dec. 29, 1982

[30] Foreign Application Priority Data

Mar. 31, 1982 [EP] European Pat. Off. ..... 82301684.5

[51] Int. Cl.[3] ..... H01F 7/00

[52] U.S. Cl. ..... 335/210; 335/212

[58] Field of Search ..... 335/210, 212, 213; 313/421

[56] References Cited

U.S. PATENT DOCUMENTS

| | | | |
|---|---|---|---|
| 3,325,675 | 6/1977 | Sanford | 315/13 |
| 3,743,984 | 7/1973 | Takenaka et al. | 335/212 |
| 3,858,134 | 12/1974 | Budd | 335/210 X |
| 4,034,324 | 7/1977 | Sano et al. | 335/212 |

FOREIGN PATENT DOCUMENTS

| | | | |
|---|---|---|---|
| 2949851 | 6/1981 | Fed. Rep. of Germany | 335/212 |
| 1330827 | of 0000 | United Kingdom . | |

OTHER PUBLICATIONS

IBM Technical Disclosure Bulletin, vol. 24, No. 2, Jul. 1981, pp. 1061–1062.

Soviet Inventions Illustrated, vol. R45, 30th Apr. 1980, No. C7202C/12, London.

*Primary Examiner*—George Harris

*Attorney, Agent, or Firm*—Frederick D. Poag

[57] ABSTRACT

A convergence unit for an in-line color cathode ray tube consists of four E-cores located around the neck of the CRT. Each E-core, preferably consisting of strip-shaped soft-magnetic material such as mumetal or permalloy, carries two coils connected so that the net magnetic field at the central beam is zero. The E-cores are arranged in paris with the resultant fields at the nearer electron beam due to each individual E-core being substantially orthogonal to one another.

8 Claims, 10 Drawing Figures

CONVERGENCE UNIT FOR IN-LINE COLOR CATHODE RAY TUBE

BACKGROUND OF THE INVENTION

1. Field of the Invention

This invention relates to a convergence unit for an in-line color cathode ray tube.

2. Description of the Prior Art

As is explained in the co-pending U.S. application Ser. No. 454,397 filed Dec. 29, 1982 of the same filing date and title as the present application, there have been two basic approaches to the provision of convergence units for in-line cathode ray tubes. In one approach, four-pole and six-pole fields are used to cause vertical and horizontal shifting of the outer electron beams. In the other approach, as disclosed in the aforesaid application and in British Patent Specification No. 1,330,827, a pair of E-cores is employed, one for each of the outer beams. To avoid undesired shifting of the central beam, the normal requirement is for the central beam to be shielded from the magnetic fields of the E-cores. This shielding adds to the cost and complexity of the cathode ray tube.

SUMMARY OF THE INVENTION

Accordingly, it is an object of the present invention to provide an E-core type convergence unit which does not require shielding of the central beam.

According to the invention, a convergence unit for an in-line cathode ray tube comprises a plurality of E-shaped cores carrying windings and located around the neck of the cathode ray tube for providing magnetic fields for shifting one or both of the outside electron beams and is characterized in that there are four E-shaped cores, two associated with each outside electron beam, each E-shaped core being arranged to provide a substantially zero magnetic field at the central electron beam and a net magnetic field at its associated outer electron beam by means of a winding or windings causing its central pole piece to be of opposite magnetic polarity to its end pole pieces.

BRIEF DESCRIPTION OF THE DRAWINGS

The invention will now be particularly described, by way of example, with reference to the accompanying drawings in which.

DETAILED DESCRIPTION

Figure 1:
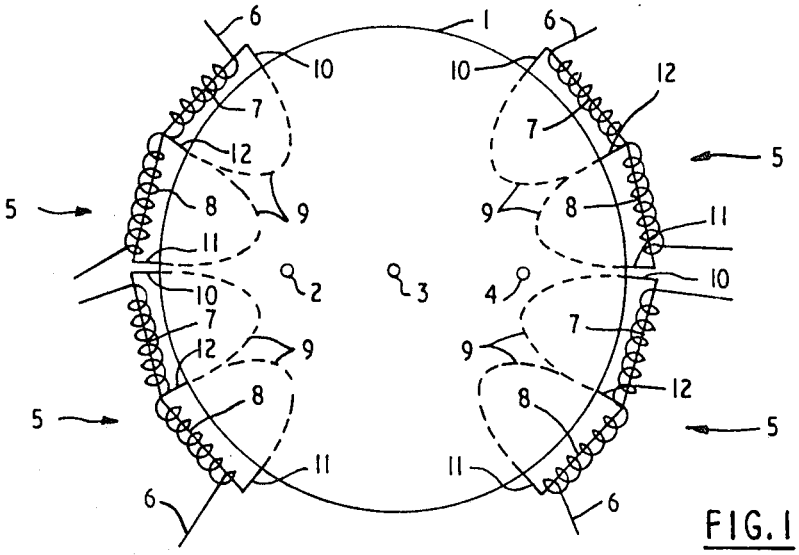
FIG. 1 is a schematical view of the neck of an in-line cathode ray tube showing a first embodiment of convergence unit.

FIG. 1 is a sectional view of the neck 1 of an in-line cathode ray tube having "red", "green" and "blue" electron beams 2, 3, and 4 respectively with four E-cores 5 located around the neck. Each E-core 5 is formed from a strip of soft-magnetic material such as mumetal or permalloy and has a winding 6 which extends over both limbs 7 and 8 of the E-core but in opposite senses so that when energized it will produce a magnetic field 9 of the shape shown. A reasonable separation between the E-cores is desirable to minimize coupling between them.

Figure 2:
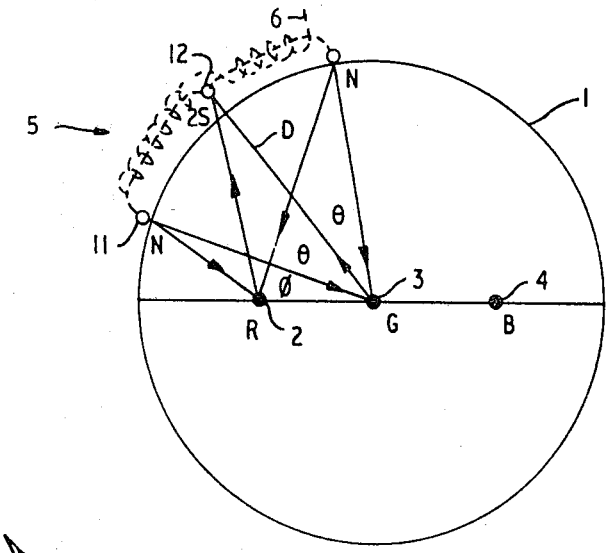
FIGS. 2 to 4 serve to explain the operation of the present invention.

Each E-core and its coil 6 is designed so that it can be driven independently of the other E-cores to shift the beam nearest to it but to produce substantially zero field and hence substantially zero shift of the central "green" beam 3. This is explained with reference to FIG. 2 which shows a single E-core 5 having equal-length limbs having the same number of turns. This results in a pole strength of N at the end poles 10 and 11 and a pole strength of 2 S at the central pole 12. In the example shown each limb subtends an angle of $\theta$ at the center 3 of the tube with the pole piece 11 subtending an angle of $\phi$ with the plane of the electron beams. To achieve zero field at the center of the tube with the three poles on the tube circumference would require the central pole to have a pole strength of 2 S cos $\theta$ which is impossible since the poles must sum to zero.

Figure 3:
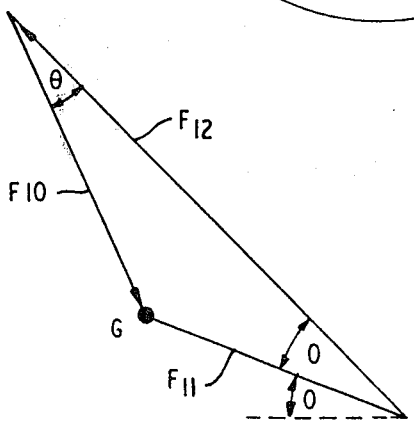

However the field due to pole 12 seen at the center beam 3 can be reduced to the desired level if the center pole 12 is moved away from the neck circumference 1. The actual position of the pole piece 12 will depend on the dimension of the tube and the E-core. Magnetic field strength depends on an inverse square law using peak field values but has an inverse dependence if the integration of the field along the path of the beam is considered. Table I below shows the calculated field strength for the 1/D dependency and the angles of the resultant field for both 1/D and $1/D^2$ dependencies, assuming a neck diameter of 29 mm and electron beam separation of 7 mm, for the magnetic field components at the "red" beam due to the individual poles. FIG. 3 is a vector diagram showing pictorally how the field $F_{10}$, $F_{11}$ and $F_{12}$ at the "green" beam exactly balance out. Because the sensitivity varies with the position of the beam along the neck of the tube, the true position of the pole piece 12 would need to be determined experimentally but would be expected to be approximately equal to the values shown in Table I. It should be noted that Table I shows theoretical values for the distance D assuming fields only from the poles and ignoring interaction with other E-cores. The calculations assume unit poles at pole pieces 10 and 11 and 2 unit poles at the central pole piece 12. The field strength factor is proportional to the net field strength at the beam position.

TABLE I

| Angle between Poles of E-core (Degrees) θ | Angle between Pole Piece No. 11 and electron beam plane (Degrees) Ø | Field at Red beam Assuming Field integration along beam D = 16.74 mm: Angle of field to horizontal (Degrees) | Field at Red beam Assuming Field integration along beam D = 16.74 mm: Field Strength | Field at Red beam taking maximum field at beam D = 15.58 mm: Angle of Field to horizontal (Degrees) |
|---|---|---|---|---|
| 20 | 0 | 8.7 | 4.11 | − 3.0 |
| 30 | 0 | −17 | 6.91 | −32.4 |
| 30 | 5 | −33.5 | 6.97 | −49.9 |
| 30 | 8 | −43 | 6.67 | −59.5 |
| 30 | 8.5 | −44.5 | 6.60 | −61.0 |
| *30 | 8.6 | −44.9 | 6.58 | −61.3 |
| 30 | 9 | −46.1 | 6.53 | −62.5 |
| 30 | 10 | −49.2 | 6.35 | −65.5 |
| 30 | 15 | −64.0 | 5.36 | −79.5 |
| 35 | 0 | −27.1 | 8.41 | −43.1 |
| 35 | 5 | −42.7 | 8.08 | −58.9 |
| *35 | 6 | −45.8 | 7.93 | −61.9 |
| 35 | 8 | −51.8 | 7.57 | −67.7 |
| 35 | 10 | −57.7 | 7.13 | −73.2 |
| 35 | 15 | −71.9 | 5.84 | −86.0 |

The asterisks denote cases where the angle is close to 45°.

Figure 4:
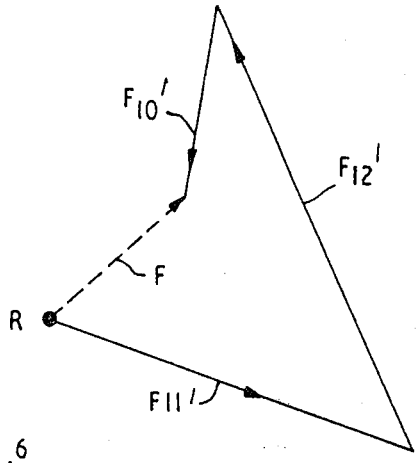

FIG. 4 is a field vector diagram at the red beam showing a resultant field vector F due to fields $F_{10}'$, $F_{10}'$ and $F_{12}'$ from poles pieces 10, 11 and 12 respectively. The strength of this field F will depend inter alia on the current flowing through the coil 6.

In a similar manner, the other E-core and coil combination adjacent the red beam can be arranged to produce a resultant magnetic field that is orthogonal to the first. Thus a field of any particular direction and magnitude can be produced at the red beam using the two E-cores with substantially zero field at the green beam. The remaining two E-cores take care of the shifting of the blue beam. Experiment can quickly establish the correct arm length and precise orientation on the neck to achieve the desired angle of shift. The shift observed on the far beam is not zero but in practice is so small, being less than 10% of the shift on the near beam, that for present purposes it can be ignored.

Figure 5:
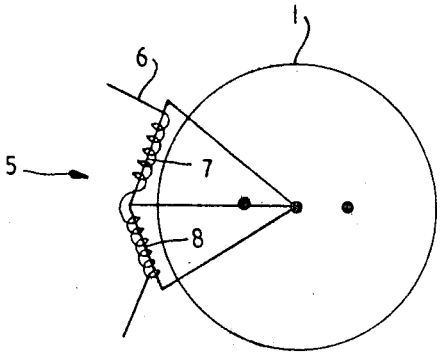
FIG. 5 is a schematic of a second embodiment of the invention.

In the embodiment described above, the limbs of the E-cores are equal in length and have an equal number of turns. In the embodiment of FIG. 5, the limbs 7 and 8 are of unequal length and carry an unequal number of turns. By adjusting the number of turns on each limb, zero field can be obtained at the center beam. Table II below shows the inductance L (in microhenries), current I (in amps) to produce 1 mm shift and the energy factor $LI^2$ (in microjoules) required for each 1 mm of shift. Each E-core was made from 5 mm wide strip mumetal material with pole pieces approximately 2 mm long. The unit can be positioned on the neck 1 with such an orientation as to give a 45° shift of the red beam. A second unit can be positioned to give a shift at 90° to the first. A second pair of E-cores can be positioned to influence the blue beam, that is 4 E-cores in all.

N.B. In this embodiment, the E-cores are side by side along the neck of tube, i.e. at different points along the Z-axis. This is because the angular coverage of each pair of E-cores overlaps.

TABLE II

| Limb 1 length (mm) | No. of turns | Limb 2 length (mm) | No. of turns | Inductance L | Current I | Energy factor per mm shift ($LI^2$) |
|---|---|---|---|---|---|---|
| 8 | 65 | 8 | 65 | 97 | 0.25 | 6 |
| 9 | 65 | 9 | 65 | 91 | 0.25 | 5.7 |

TABLE II-continued

| Limb 1 length (mm) | No. of turns | Limb 2 length (mm) | No. of turns | Inductance L | Current I | Energy factor per mm shift ($LI^2$) |
|---|---|---|---|---|---|---|
| 10 | 65 | 10 | 65 | 97 | 0.2 | 3.9 |
| 11 | 65 | 11 | 65 | 80 | 0.25 | 5 |
| 6 | 60 | 13 | 40 | 46 | 0.325 | 4.8 |
| 6 | 55 | 15 | 45 | 91 | 0.21 | 4.2 |
| 7 | 60 | 13 | 40 | 56 | 0.25 | 3.5 |
| 8 | 65 | 12 | 40 | 50 | 0.2 | 2.0 |
| 8 | 65 | 13 | 40 | 55 | 0.11 | 0.6 |

It will be seen that the most efficient E-core/coil combination is one having arm lengths of 8 and 13 mm with 65 and 40 turns respectively, that is arms subtending angles of approximately 30° and 50° respectively with its "central" pole aligned with the plane of the in-line beams.

Figure 6:
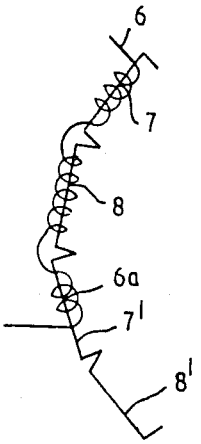
FIG. 6 shows a modification of the invention.

FIG. 6 shows a modification of the invention designed to overcome a problem which can arise when two E-cores are formed as two separate windings on a single strip of magnetic material. In this situation, one E-core is formed from limbs 7 and 8 and then the other E-core by limbs 7' and 8'. Only one winding is shown but if it were the only winding to be energized and were wound on parts 7 and 8 only, the pole would be spread over 7'. To compensate for this, the winding can be extended, but wound in the reverse sense, over the limb 7' with half the number of turns used on each of the other limbs 7 and 8 as represented by *6a*. Thus, the winding 6 would consist of n turns in one sense on limb 7, n turns of the opposite sense on limb 8 and n/2 turns of the one sense on limb 7' (*6a*). The precise numbers of turns would need to be established experimentally to compensate for fringe field effects.

Figure 7:
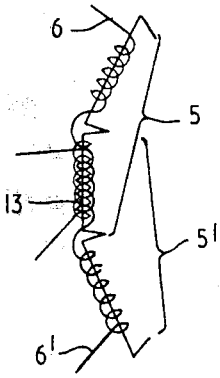
FIG. 7 shows yet another embodiment of the invention n in which two adjacent E-cores share a common limb.

FIGS. 7 shows a further embodiment of the invention where two E-cores 5 and 5' having windings 6 and 6' respectively share a common limb 13.

Figure 8:
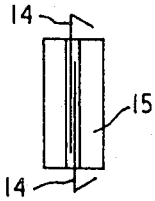
FIGS. 8 to 10 show how the E-cores could be formed with bobbins.
Figure 9:
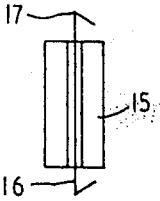
Figure 10:
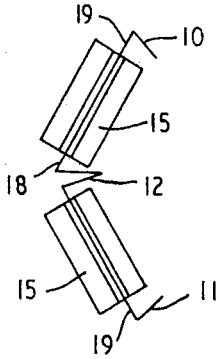

In all the embodiments described above, each E-core is described as having a single winding extending over both limbs of the core but wound in opposite senses on the two limbs. It will be apparent that two separate windings could be used, one on each limb, provided that they are wound or connected to reverse the magnetic polarity of the central pole piece compared with the end pole pieces. Although the windings may be wound directly over the strip shaped cores, it is possible to wind the windings onto hollow bobbins into which strip shaped core material can be subsequently inserted. These bobbins may then be mounted on a printed circuit card surrounding the neck of the tube. FIG. 8 shows how part of an E-core can be made using two L-shaped mumetal or permalloy strips 14 inserted into a pre-wound bobbin 15 although moulded ferrite parts could be used in the particular case as no bending is needed. FIG. 9 illustrates how a single L-shaped strip 16 can be inserted into a pre-wound bobbin 15 and subsequently bent as at 17 to provide a half of the E-core: The E-core would be completed by using two such units together. FIG. 10 shows two bobbins 15 and 15' inserted on the two limbs of a pre-formed strip 18; subsequently the strip is bent at 19 to form pole pieces 10 and 11.

For the embodiment of FIGS. 6 and 7, the convergence unit can be built up from a number of single and double wound bobbins.

What has been described is a convergence unit consisting of 4 E-cores. Each E-core is constructed to give a magnetic field at its nearer electron beam of 45° to the plane of the in-line beams and substantially zero field at the central beam. This avoids the necessity of providing magnetic shielding inside the neck of the cathode ray tube.

What is claimed is:

1. A convergence unit for an in-line color cathode ray tube comprising a pluraity of E-shaped cores carrying windings and located around the neck of the cathode ray tube for providing magnetic fields for shifting one or both of the outside electron beams to correct for misconvergence at the screen of the cathode ray tube, characterized in that there are four E-shaped cores, two associated with each outside electron beam each E-shaped core being arranged to provide a substantially zero magnetic field at the center electron beam and a net magnetic field at its associated outer electron beam by means of a winding or windings causing its central pole piece to be of opposite magnetic polarity to its end pole pieces.

2. A convergence unit as claimed in claim 1, characterized in that each E-shaped core has two limbs of equal length carrying an equal number of turns, said central pole piece being further from said central electron beam than said end pole pieces.

3. A convergence unit as claimed in claim 1, characterized in that each E-shaped core has two limbs of unequal length carrying an unequal number of turns.

4. A convergence unit as claimed in claim 1, 2 or 3 wherein each pair of E-shaped cores shares a common core each E-shaped core having a single winding wound with its main part on two adjacent limbs and a minor part wound on the next adjacent limb to restrict the magnetic poles when the winding of only one E-shaped core is energized.

5. A convergence unit as claimed in claim 1, 2 or 3, in which each pair of E-shaped cores shares a common limb.

6. A convergence unit as claimed in claim 1, 2 or 3, in which each E-shaped core is formed from two pre-wound bobbins.

7. A convergence unit as claimed in claim 1, 2 or 3, characterized in that each E-shaped core is positioned and/or constructed to produce a net magnetic field at its associated outside electron beam at an angle of substantially 45° to the plane of the electron beams, the net fields due to paired E-shaped cores being substantially orthogonal to one another.

8. A convergence unit as claimed in claim 1, 2 or 3, in which each E-shaped core is formed from a strip of soft-magnetic material, the width of the strip material extending parallel to the path of the electron beams.

* * * * *